US009616357B2

(12) United States Patent
Sowka et al.

(10) Patent No.: US 9,616,357 B2
(45) Date of Patent: Apr. 11, 2017

(54) DRIVE UNIT FOR AT LEAST ONE TRACTION MEANS

(75) Inventors: Maurycy Sowka, Borchen (DE); Detlef Iseken, Salzkotten (DE)

(73) Assignee: ASM Steuerungstechnik GmbH, Bad Wunnenberg-Haaren (DE)

( * ) Notice: Subject to any disclaimer, the term of this patent is extended or adjusted under 35 U.S.C. 154(b) by 339 days.

(21) Appl. No.: 14/003,473

(22) PCT Filed: Mar. 7, 2012

(86) PCT No.: PCT/DE2012/000221

§ 371 (c)(1),
(2), (4) Date: Dec. 2, 2013

(87) PCT Pub. No.: WO2012/119585

PCT Pub. Date: Sep. 13, 2012

(65) Prior Publication Data

US 2014/0080615 A1 Mar. 20, 2014

(30) Foreign Application Priority Data

Mar. 7, 2011 (DE) ..... 20 2011 003 649 U

(51) Int. Cl.
*A63J 1/02* (2006.01)
*B66C 1/20* (2006.01)
(Continued)

(52) U.S. Cl.
CPC ..... *A63J 1/028* (2013.01); *B66D 1/20* (2013.01); *B66D 1/60* (2013.01)

(58) Field of Classification Search
CPC ..... A63J 1/20; A63J 1/028; A63J 1/02; B66D 1/20; B66D 1/34; B66D 1/36; B66D 1/60;
(Continued)

(56) References Cited

U.S. PATENT DOCUMENTS 193,333 A * 7/1877 Hawkins ..... B66D 1/20 254/359
410,507 A * 9/1889 Fain ..... B66D 1/36 182/144
(Continued)

FOREIGN PATENT DOCUMENTS

DE 3525399 A1 * 1/1987 ..... A63J 1/028

OTHER PUBLICATIONS

English translation of DE 3525399 A1.*
PCT/DE2012/000221; PCT International Search Report mailed Jul. 10, 2012.

*Primary Examiner* — Sang Kim
*Assistant Examiner* — Nathaniel Adams
(74) *Attorney, Agent, or Firm* — Renner, Otto, Boisselle & Sklar, LLP

(57) ABSTRACT

A drive unit for at least one traction means, especially in stage machinery, with a winding drum comprising at least one take-up region, on (each of) which a traction means is received which can be wound up or unwound, characterized in that axially adjacent to the take-up region there is a cylindrical drive region disposed on the winding drum, on which is received a belt-shaped drive means that can be wound up or unwound and which can be wound up onto a drivable drive drum, generating a drive torque acting on the winding drum, or can be unwound from the drive drum, releasing the winding drum.

12 Claims, 4 Drawing Sheets

Figure 1:
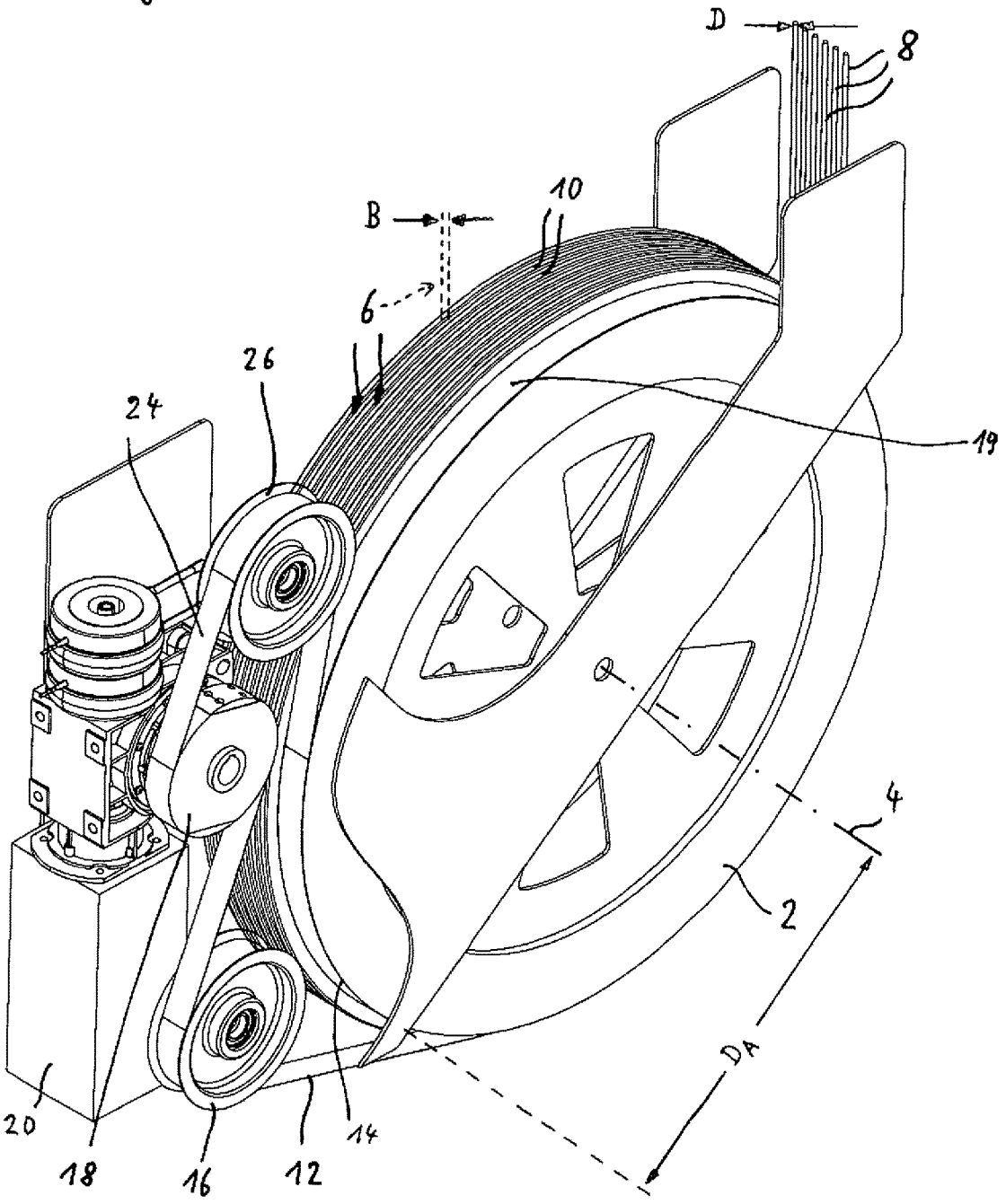

(51) Int. Cl.
*B66D 1/20* (2006.01)
*B66D 1/60* (2006.01)

(58) Field of Classification Search
CPC .... B66D 2700/0166; B66D 2700/0191; B66D 2700/026
See application file for complete search history.

(56) References Cited

U.S. PATENT DOCUMENTS

| | | | | | |
|---|---|---|---|---|---|
| 977,498 | A | * | 12/1910 | Bailey | A63J 1/028 160/339 |
| 3,456,891 | A | | 7/1969 | Parr | |
| 4,199,133 | A | * | 4/1980 | Gagnon | A63J 1/028 160/334 |
| 4,606,527 | A | * | 8/1986 | Ziller | A63J 1/028 254/336 |
| 5,482,100 | A | * | 1/1996 | Kuhar | E06B 9/32 160/170 |
| 6,685,602 | B2 | * | 2/2004 | Colosky, Jr. | A63B 21/025 482/122 |
| 2007/0278046 | A1 | * | 12/2007 | Hoffend, III | A63J 1/028 187/261 |
| 2009/0127527 | A1 | | 5/2009 | Hoffend, III | |

* cited by examiner

DRIVE UNIT FOR AT LEAST ONE TRACTION MEANS

The invention relates to a drive unit for at least one traction means such as a traction cable or belt, especially in stage machinery, with a winding drum comprising at least one take-up region, on (each of) which a traction means is received which can be wound up or unwound.

DE 10 2005 049 105 A1 discloses a drive unit for lifting systems for stage machinery, in which a flat belt is used as the traction means for raising and lowering a load. Even though an embodiment of this kind is advantageous with regard to the short overall axial length, a major disadvantage is that the drive unit has to be configured to generate great torque in order to be able still to turn the winding drum against the tensile force of the load when a certain—or considerable—length of the flat belt has been wound up and thus a substantial effective diameter has been reached.

The problem of the invention consists in avoiding the above-mentioned disadvantage of the state of the art and in improving a drive unit for at least one traction means in such a way that a relatively small transmission unit is sufficient for the drive, while maintaining a short overall axial length.

This problem is solved in a drive unit of the generic kind by having a cylindrical drive region disposed on the winding drum axially adjacent to the take-up region, on which is received a belt-shaped drive means that can be wound up or unwound and which can be wound up onto a drivable drive drum, generating a drive torque acting on the winding drum in the process, or can be unwound from the drive drum, releasing the winding drum.

In accordance with the invention, it is thus possible to avoid causing the winding drum to begin rotating about its axis, generating necessarily great torque. Instead, the winding drum is caused to rotate by the tensile force of a belt-shaped drive means wound up on the winding drum itself, in the course of which a comparatively small tensile force of a drive means is sufficient. Furthermore, a drive of this kind is extremely low-noise, which is of considerable importance in the case of applications in the field of stage machinery.

It may be contemplated that the winding drum comprises at least one cylindrical take-up region for winding up a number of coils of the traction means lying axially side by side. This has the advantage of providing constant drive torque, though it may also entail the disadvantage of a comparatively large overall axial length.

Alternatively, there is the possibility that the winding drum comprises at least one slot-shaped take-up region running radially, the axial width of which is the same as or marginally greater than a diameter or a width of the traction means, for taking up a number of coils of the traction means lying one on top of the other in the radial direction. This embodiment has the advantage of a small overall axial length, where at the same time the drive torque likewise varies because of the variable effective diameter of the coil of the traction means.

Irrespective of the specific embodiment, the take-up region may have a basic diameter of 0.3 meters to 2 meters, especially 0.7 meters to 1.2 meters, where, in the case of a cylindrical take-up region, this is the diameter of the latter and, in the case of a slot-shaped take-up region running radially, it is the smallest diameter of the latter.

It may also be contemplated that the cylindrical drive region has a diameter of 0.3 meters to 2 meters, especially 0.7 meters to 1.2 meters, though in operation, the thickness of the drive means which has already been wound up at any particular time has to be added to that diameter, from which an effective diameter can then be calculated.

The drive means is preferably a steel belt with a width of 5 mm to 50 mm and a thickness of 0.05 to 0.5 mm.

On the cylindrical drive region of the winding drum, it is additionally possible to mount a belt-shaped securing element, for example likewise a steel belt, which can be wound onto or unwound from the drive drum at the same time as the drive means. If the drive means or the securing element should fail or break, the respective other, intact drive means or securing element is still available.

It may be contemplated that there are associated with the drive drum a self-locking gear and/or two independent brakes.

It may in particular be contemplated that the winding drum is coupled to a torsion tension spring, which biases the winding drum opposite to a direction of rotation tensioning the at least one traction means. This avoids a situation in which, as the tension of the traction means relaxes, the drive means wound onto the winding drum itself loses tension and is released in an undesirable manner from the winding drum or the drive region.

The problem of the invention is further solved by a scenery hoist with a plurality of drive units in accordance with the invention, which may be arranged axially side by side, spaced apart by no more than 30 cm, no more than 25 cm or no more than 20 cm. The construction design of the invention makes it possible to have adjacent drive units spaced apart by comparatively small distances.

Figure 3:
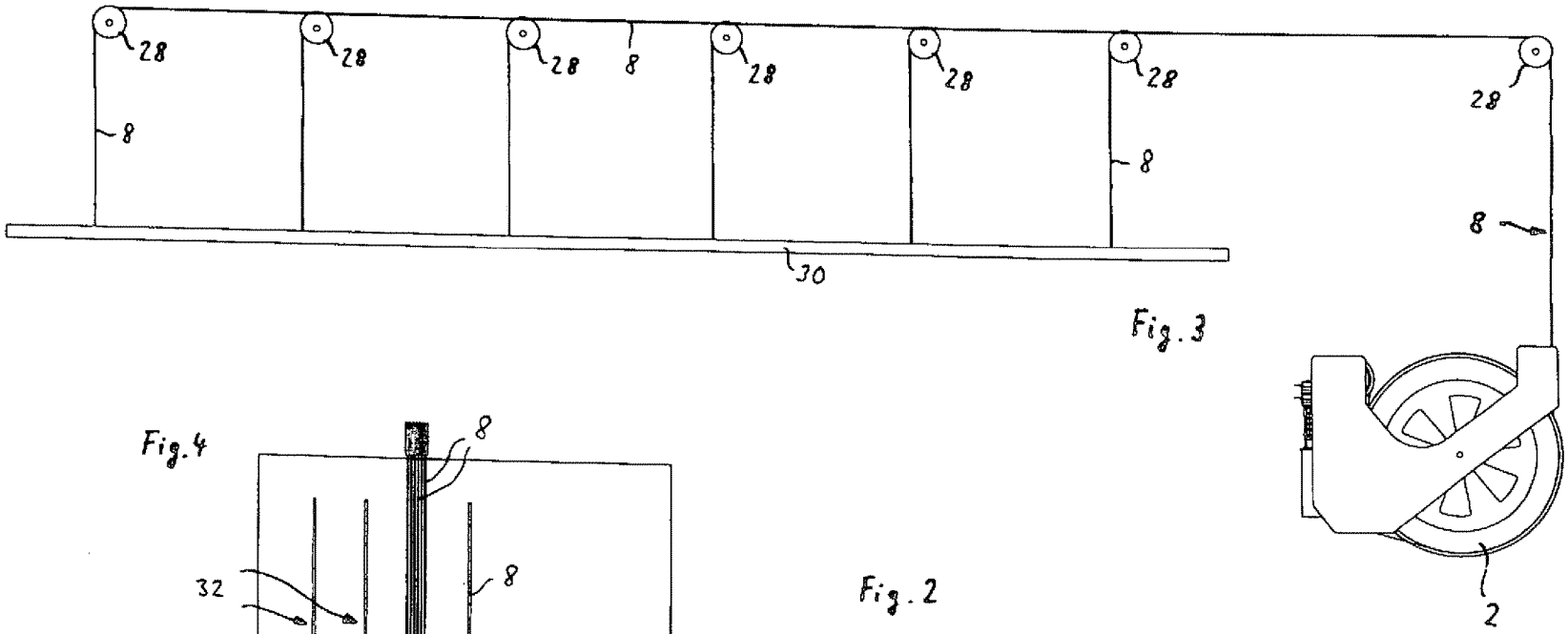
Figure 2:
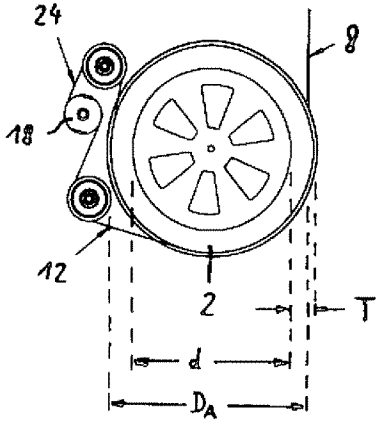
Figure 4:
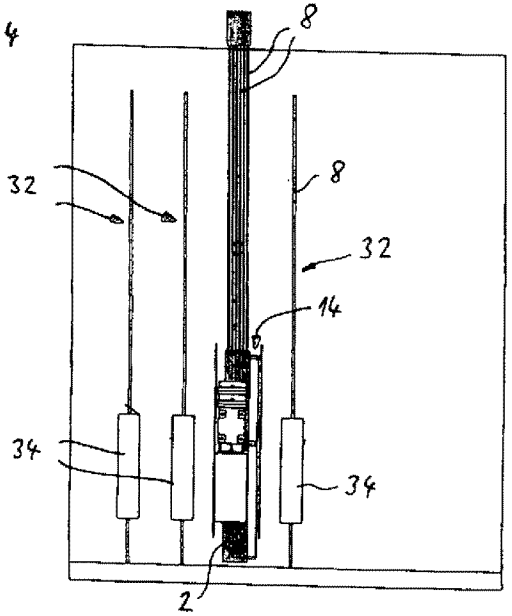

Further advantages and features of the invention will become clear from the following description of a preferred embodiment, reference being made to a drawing in which FIG. 1 shows a perspective view of a drive unit in accordance with the invention, FIG. 2 shows a schematic side view in an axial direction, FIG. 3 shows a side view of a scenery hoist with a drive unit in accordance with the invention, FIG. 4 schematically shows an installation situation of a drive unit in accordance with the invention as a replacement for a manual counter hoist within a row of a plurality of manual counter hoists.

Figure 5:
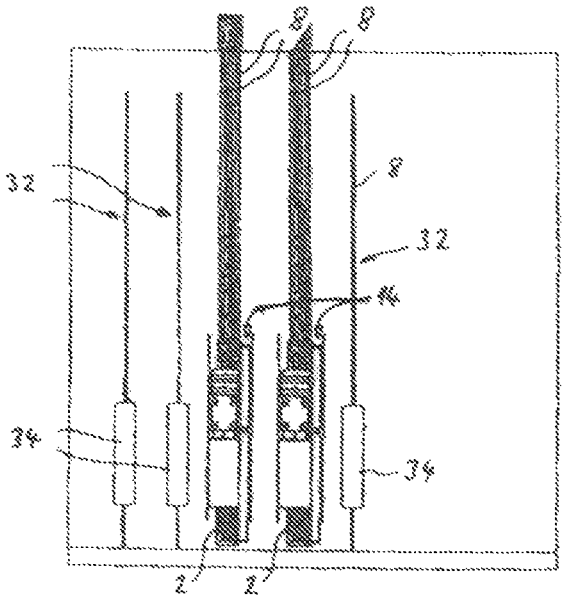

FIG. 5 schematically shows a scenery hoist with a plurality of drive units in accordance with an embodiment of the invention.

Figure 6:
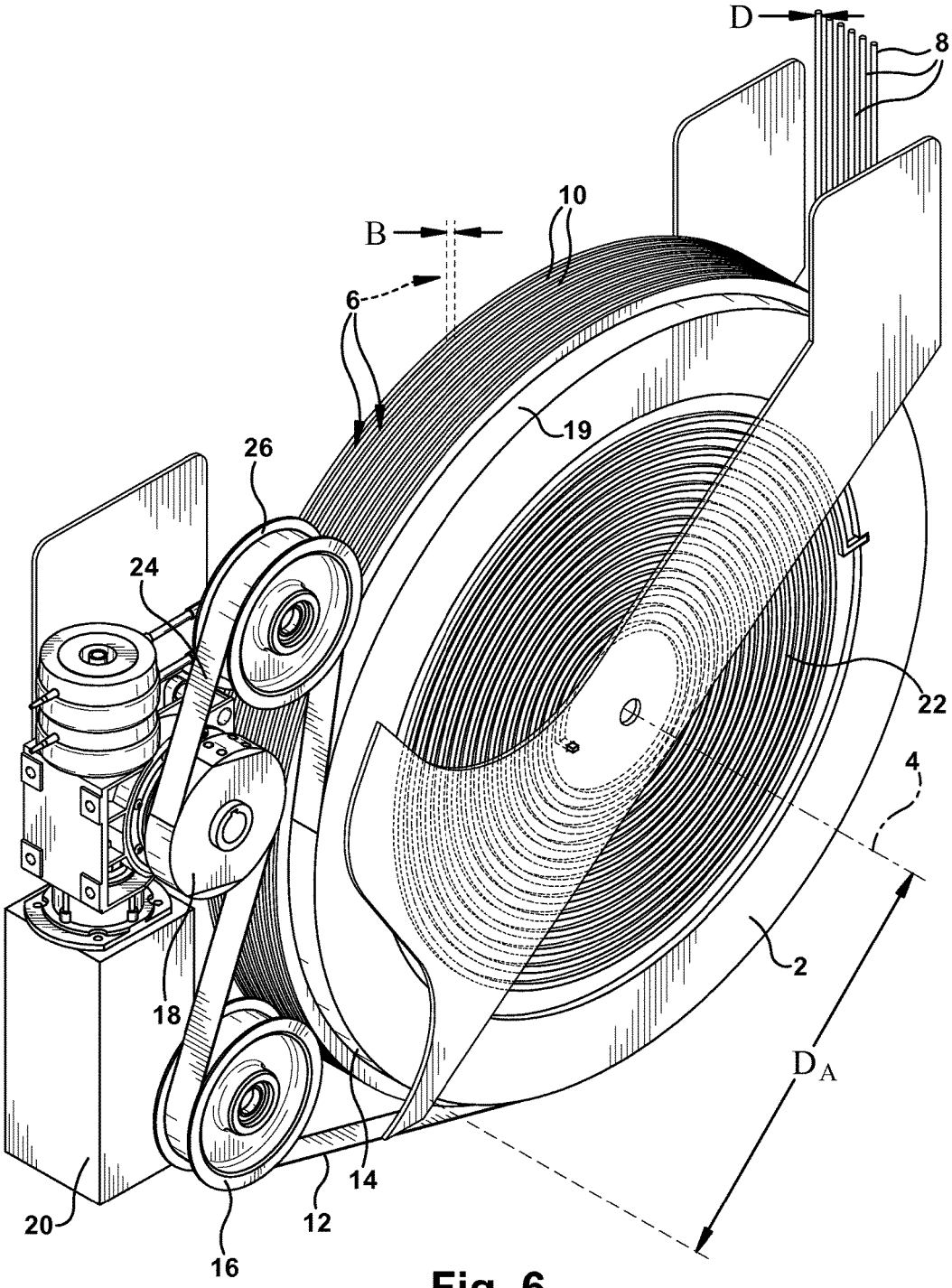

FIG. 6 shows a perspective view of a drive unit in accordance with the invention, in which drive unit is cut away to show the torsion tension spring.

FIG. 1 shows a perspective view of a complete drive unit for a scenery hoist in the stage machinery, with a winding drum 2 which is rotatably driven about an axis of rotation 4. The winding drum 2 has six take-up regions 6 arranged immediately adjacent to one another for individual traction means, in this case fraction cables 8, which are configured in the form of receiving spaces with a basic diameter d which are slot-shaped or shaped like cylindrical rings and run radially to the axis of rotation 4 and are separated from one another by narrow partitions 10 disposed between them in each case. A clear width B of each take-up region 6 corresponding to a diameter D of a traction cable received therein (or of a width of a traction belt) or is slightly larger, so that the traction means concerned can be wound up in a take-up region 6 with no difficulty. For this purpose, an end of each fraction means 8 on the winding drum side is fixed to the winding drum 2 at the base of its take-up region 6 and, when being wound up, is taken up in coils lying radially on top of one another, without being able to escape axially.

Alternatively, one or more traction belts may be used instead of traction cables, such as in the form of steel belts.

Although the individual traction cables 8 and their take-up regions 6 have the same diameter D or the same width B in the example illustrated, the possibility exists of using different cable diameters (or traction belt widths) in take-up regions of different widths if particular effects can be achieved in this way because of the resulting different strengths and/or different winding speeds or winding paths.

With traction cables, there is the additional possibility, instead of the system illustrated with spirally winding coils that lie on top of one another in the radial direction and increase in diameter in the process, to provide for winding up in coils of the same diameter that lie axially side by side, though in this case, the overall axial length of the winding drum and the drive unit as a whole increases. This may be convenient in an individual case if uniform winding speeds or winding paths, i.e. independent of the amount wound up, are to be achieved for each rotation of the winding drum.

The winding drum 2 is driven by a belt-shaped drive means 12, which may be configured as a steel belt. The drive means 12 is taken up on a cylindrical drive region 14 of the winding drum 2, an end portion of the drive means 12 being fixed to the winding drum 2 on the winding drum side. The drive means 12 runs via a return roller 16 to a drive drum 18, which can in principle be driven manually or by a motor and, in the embodiment illustrated, can be driven by a geared motor 20 optionally in the drive or release direction.

The geared motor 20 may have a dynamically self-locking or other self-locking gear, such as a worm gear, and it may be equipped in addition or alternatively with two independently acting brakes.

In addition to the drive means 12, the drive unit has a belt-shaped securing element 24 which, like the drive means 12, is taken up on the drive region 14 of the winding drum 2 and is fixed to the winding drum on the winding drum side. The securing element 24 serves to ensure, in the event of failure, rupture or the like, of the drive means 12, that the traction means 8 cannot unwind in an uncontrolled manner. The securing element 24 is guided via a spring-loaded return roller 26, which ensures that the securing element 24 remains taut, to the drive drum 18, on which, like the drive means 12, it is fixed at the end and is wound up when the drive drum 18 rotates at the same time and speed as the drive means 12.

FIG. 2 shows a schematic side view of the drive unit in an axial direction, where a radial depth T of the take-up regions 6 for the traction means 8 can be seen, which, in the example illustrated, is about 25% of the radius (0.5 $D_A$) of the drive region 14, though it may also be made larger or smaller and may, for example, be up to 10%, 20%, 30%, 50% or 75% of the radius of the drive region 14. The basic diameter d of the take-up regions 6 is likewise given.

FIG. 3 shows a schematic side view of a scenery hoist formed with the drive means, the fraction means 8 being guided via stationary return rollers 28 and supporting a load-bearing rod 30.

FIG. 4 shows a plan view, transverse to the axis of rotation of the winding drum, of an array of a plurality of scenery hoists, three of which are configured as manual counter hoists 32 with counter-weights 34, and a scenery hoist disposed between two manual counter hoists which is equipped with a drive unit in accordance with the invention, which thanks to the small overall axial length fits conveniently between two manual counter hoists.

FIG. 5 schematically shows an embodiment of a scenery hoist in accordance with an embodiment of the invention, similar to FIG. 4, except that the scenery hoist in FIG. 5 has two (a plurality of) drive units rather than a single drive unit as in FIG. 4.

FIG. 6 shows a perspective view of a drive unit such as that shown in FIG. 1, but with a cutaway view showing torsion tension spring 22 which biases the winding drum 2 opposite to a direction of rotation in which the winding drum rotates when the at least one traction means is tensioned.

LIST OF REFERENCE NUMERALS

2 winding drum
4 axis of rotation
6 take-up region
8 fraction means (traction cable)
10 partition
12 drive means
14 drive region
16 return roller
18 drive drum
20 geared motor
24 securing element
26, 28 return roller
30 load-bearing rod
32 manual counter hoist
34 counter-weight
D diameter (width) of 8
B width (of 6)
T radial depth (of 6)
d basic diameter (of 6)
$D_A$ diameter (of 14)

The invention claimed is:

1. A drive unit for at least one traction means, the drive unit comprising a winding drum comprising at least one take-up region, on (each of) which a traction means is received which can be wound up or unwound, characterised in that axially adjacent to the take-up region there is a cylindrical drive region disposed on the winding drum, on which is received a drive belt that can be wound up onto or unwound from the winding drum, a drive drum configured to be driven by a geared motor and being positioned such that the drive belt can be wound up onto the drivable drive drum, generating a drive torque acting on the winding drum in the process, or the drive belt can be unwound from the drive drum, releasing the winding drum, and wherein a first end of the drive belt is fixed to the drive drum and a second end of the drive belt is fixed to the winding drum, and wherein the winding drum is coupled to a torsion tension spring which biases the winding drum opposite to a direction of rotation in which the winding drum rotates when the at least one traction means is wound up onto the winding drum.

2. The drive unit as claimed in claim 1, characterised in that the winding drum comprises at least one cylindrical take-up region for winding up a number of coils of a traction cable lying axially side by side.

3. The drive unit as claimed in claim 1, characterised in that the winding drum comprises at least one slot-shaped take-up region running radially, the axial width (B) of which is the same as or greater than a diameter (D) or a width of the traction means, for taking up a number of coils of the traction means lying one on top of the other in the radial direction.

4. The drive unit as claimed in claim 1, characterised in that the take-up region has a basic diameter (d) of 0.3 to 2 m.

5. The drive unit as claimed in claim 4, wherein the take-up region has a basic diameter (d) of 0.7 to 1.2 m.

6. The drive unit as claimed in claim 1, characterised in that the cylindrical drive region has a diameter ($D_A$) of 0.3 to 2 m.

7. The drive unit as claimed in claim 6, wherein the cylindrical drive region has a diameter (DA) of 0.7 to 1.2 m.

8. The drive unit as claimed in claim 1, characterised in that the drive belt is a steel belt with a width of 5 to 50 mm and a thickness of 0.05 to 0.5 mm.

9. The drive unit as claimed in claim 1, characterised in that on the cylindrical drive region of the winding drum a securing belt is mounted, which can be wound onto or unwound from the drive drum at the same time as the drive belt.

10. The drive unit as claimed in claim 1, characterised in that there are associated with the drive drum a self-locking gear and/or two independent brakes.

11. A scenery hoist, characterised in that a plurality of drive units as claimed in claim 1 are arranged axially side by side, spaced apart at distances of no more than 30 cm, no more than 25 cm or no more than 20 cm.

12. The drive unit as claimed in claim 1, wherein the drive unit is adapted for use in stage machinery.

* * * * *